US005615633A

United States Patent [19]

Cripe

[11] Patent Number: 5,615,633

[45] Date of Patent: Apr. 1, 1997

[54] WATER CRAFT WITH REMOVABLE DUCK BLIND CABIN HOUSE ASSEMBLY

[76] Inventor: James A. Cripe, 102 E. 1st, Post Falls, Id. 83854

[21] Appl. No.: 556,279

[22] Filed: Nov. 13, 1995

[51] Int. Cl.[6] ..... B63B 35/00

[52] U.S. Cl. ..... 114/351; 114/361

[58] Field of Search ..... 114/343, 351, 114/361, 362, 201 R

[56] References Cited

U.S. PATENT DOCUMENTS

| | | | |
|---|---|---|---|
| 333,391 | 12/1885 | Casaday | 114/351 |
| 2,889,839 | 6/1959 | Sheridan | 114/351 |
| 3,787,912 | 1/1974 | Heuy | 114/351 |
| 3,990,536 | 11/1976 | Wilburn | 114/351 |
| 4,979,456 | 12/1990 | Steward | 114/351 |

*Primary Examiner*—Stephen Avila
*Attorney, Agent, or Firm*—Wells, St. John, Roberts, Gregory & Matkin, P.S.

[57] ABSTRACT

A water craft with a removable duck blind cabin house assembly is described. A circumferential gunwale defines an open passenger compartment with a sole deck surface below and inboard of the gunwale. A duck blind cabin house structure is removably attached to the hull along the perimeter of the gunwale to selectively enclose the passenger compartment. A duck blind camouflage receiver is provided on the cabin house structure for releasably mounting camouflage materials about the craft. Mounting members on the hull and cabin house structure (a) secure the cabin house structure to the hull in a first condition at least partially covering the hull and forming the passenger compartment so the water craft may be utilized as a duck blind, and (b) release the cabin house structure for removal from the hull for use as an open boat. A hatch cover spans at least part of an open top hatch section at the top side of the cabin house structure, with a hatch cover support assembly selectively operable to support the hatch cover at an elevation above the open top hatch section.

21 Claims, 10 Drawing Sheets

WATER CRAFT WITH REMOVABLE DUCK BLIND CABIN HOUSE ASSEMBLY

TECHNICAL FIELD

The present invention relates generally to conversion of a water craft to and from a duck blind.

BACKGROUND OF THE INVENTION

Duck and waterfowl hunters often make use of ordinary water craft for hunting purposes. Such craft are used to transport the hunters to a blind made up of camouflage materials. The blind is usually not portable, so if the hunters wish to relocate to a new hunting area, a fresh blind must be built in that area.

As a partial solution to the above problem, special watercraft have been developed especially for hunting. Such craft have provisions for attachment of camouflage materials and as such can themselves be made up as movable duck blinds. Such craft function reasonably well for such special purposes. However, most are designed for small numbers of hunters, and it is difficult for any but devoted hunters to justify purchase of such a specialized watercraft.

Another approach to the problem has been to modify existing general purpose watercraft by using pole and canvas type blind structures, erected within the watercraft. The problem with this is that the watercraft is not easily camouflaged, and the structures are relatively fragile and are difficult and time consuming to assemble, especially in cold weather at the hunting site.

A need has therefor remained for the ability to readily transform a watercraft to and from a duck blind, thereby enabling use of the watercraft as a duck blind during hunting season, and as a fishing, utility, or recreational boat during other seasons.

BRIEF DESCRIPTION OF THE DRAWINGS

Preferred embodiments of the invention are described below with reference to the following accompanying drawings.

FIG. 5 is a top plan view;

FIG. 7 is a side view showing separation of the hull and duck blind cabin house assembly;

FIG. 10 is a top plan view illustrating hatch cover sections in pivoted positions;

FIG. 13 is a top plan view of the hull with the duck blind cabin house assembly removed.

DETAILED DESCRIPTION OF THE PREFERRED EMBODIMENTS

Figure 1:
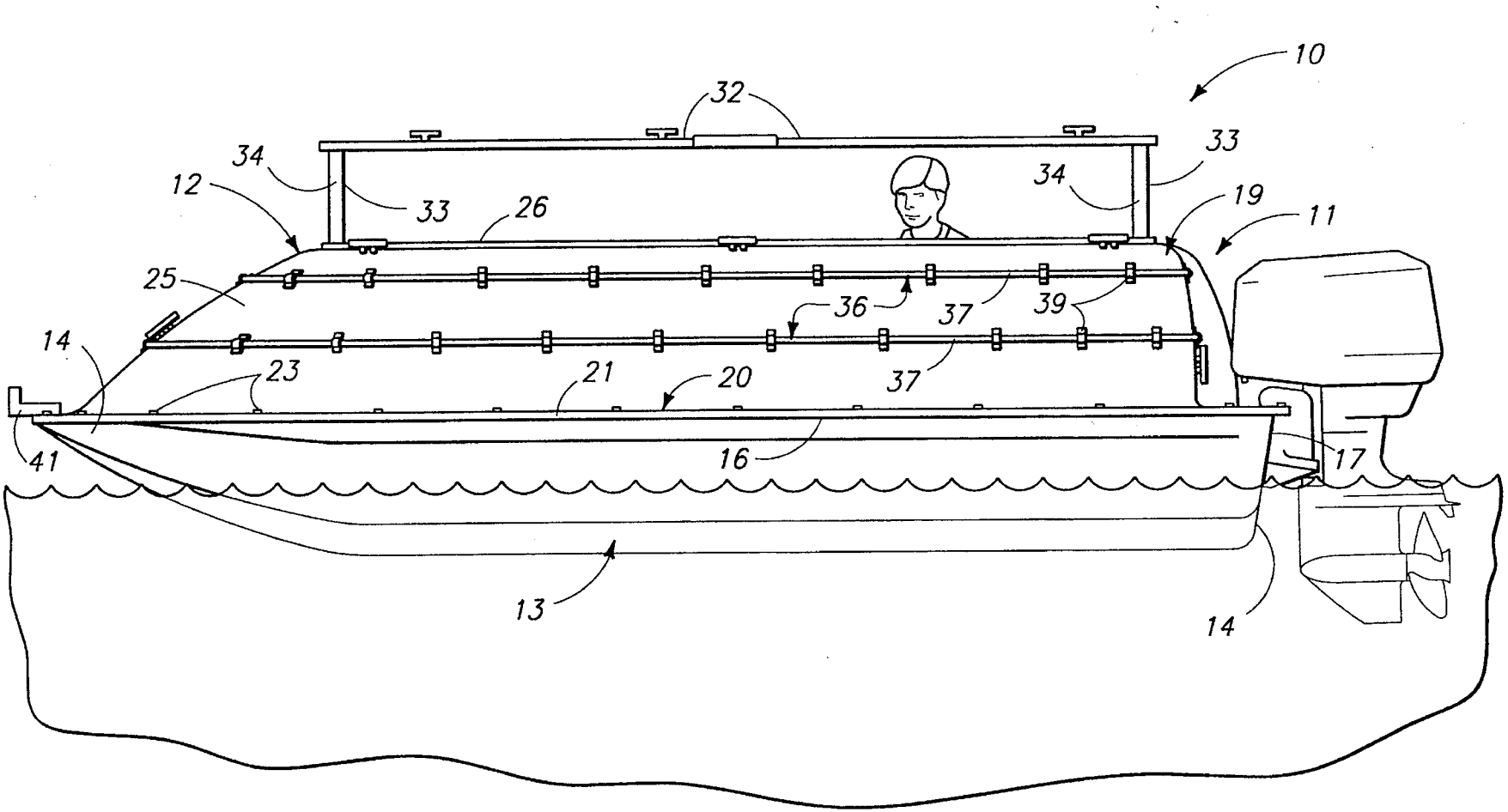
FIG. 1 is a side elevation view of a watercraft with a removable cabin house assembly exemplifying a first preferred form of the present invention in use.

This disclosure of the invention is submitted in furtherance of the constitutional purposes of the U.S. Patent Laws "to promote the progress of science and useful arts" (Article 1, Section 8).

A preferred example of the present invention is generally designated by the reference numeral 10 in the accompanying drawings.

The invention, in one preferred form includes the combination of a water craft 11 with a removable duck blind cabin house assembly 12. It is also considered that the duck blind cabin house assembly 12 may be supplied for attachment to existing forms of water craft (not shown).

The water craft 11 exemplified in the accompanying drawings generally includes a hull 13 including bow and stern ends 14, 15, and a gunwale 16 extending between the bow and stern ends. In the preferred form, the gunwale 16 extends between the bow and stern ends 14, 15. More preferably, the gunwale extends nearly about the entire perimeter of the hull, defining the hull interior or passenger compartment. The gunwale 16 terminates at an engine mount or transom 17 at the stern end 15.

The hull 13 may include an integral sole deck 18, inboard and below the gunwale 16. The sole deck 18 may be formed by an upper surface of the hull interior, or more preferably, a surface that is elevated above the hull bottom.

The area between the sole deck 18 and hull bottom may be filled with insulating flotation material known in the boat building industry, and may further include strengthening members (not shown) that lend strength and rigidity to the hull structure.

It is preferred that the hull be primarily formed of resin impregnated fiberglass in a manner commonly known in the boat building industry. However the hull could also be constructed of other materials such as aluminum, plastic, or other known materials commonly used in boat construction.

It is pointed out that the hull 13 by itself constitutes a completely operational water craft, having conventional fittings, and controls that will facilitate its use as, say, a fishing boat, a utility boat, a recreational boat, or for other purposes.

The duck blind cabin house assembly 12 includes a cabin house structure 19 that at least partially covers the hull 13 above the gunwale 16. In a preferred form, the structure 19 includes a deck 20 that elevationally overlaps at least part of the gunwale 16. The deck 20 is situated above and is substantially parallel to the sole deck 18. It substantially circumscribes the hull, inward of the gunwale 16 to allow footing about the external surfaces of the cabin house structure.

In a preferred form, the cabin house structure 19 and deck 20 are integral and formed as a monolithic shell. They may be formed of materials that are similar if not identical to the hull, as described above.

The deck 20 is formed to include a mounting member 21 about its perimeter that is adapted to engage and overlap a mating mounting member 22 on the gunwale 16. In a preferred form, the mounting members 21, 22 are releasably engageable to mount the cabin house structure 19 to the hull 13 such that the cabin house structure 19 may be selectively removed from the hull (FIG. 7).

Figure 8:
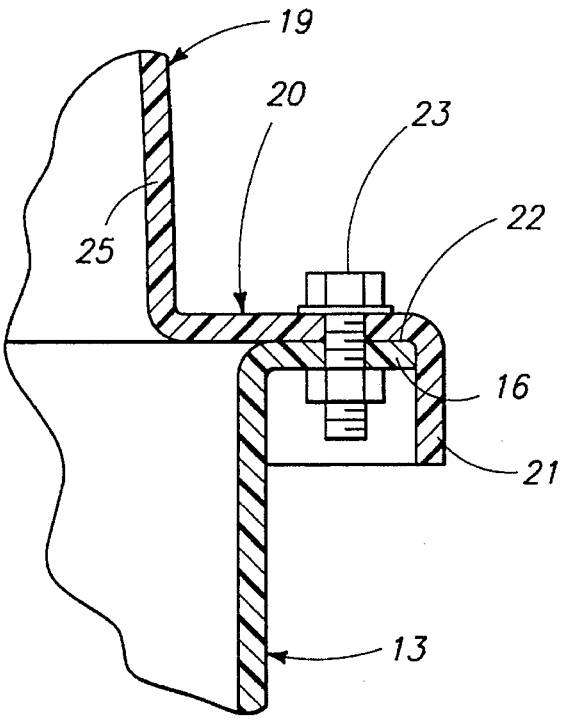
FIG. 8 is an enlarged sectional view showing a clamp arrangement for securing the hull and duck blind cabin house assembly together.

More specifically, the mounting member 22 on the gunwale 16 is formed as a first flange, as shown in detail in FIG. 8. The first flange extends nearly about the entire perimeter of the hull, and faces upwardly to receive the mounting member 21 which is shaped as a mating second flange on the perimeter of the deck 20. The first and second flanges fit in flush engagement about the hull and cabin house perimeters to provide secure but releasable support for the cabin house structure on the hull.

The mounting members 21, 22 on the hull and cabin house structure that are thus operable to (a) secure the cabin house structure 19 to the hull 13 in a first condition at least partially covering the hull 13 above the sole deck 18 and forming an at least partially enclosed passenger compartment so the water craft may be utilized as a duck blind, and (b) release the cabin house structure 19 for removal from the hull 13 to expose the sole deck such that the hull may be selectively utilized as an open boat.

Clamp assemblies 23 are provided releasably clamping the mounting members 21, 22 together, thus releasably fastening the cabin house structure 19 to the hull 13. The clamp assemblies exemplified in the drawings are simply comprised of a number of bolt and nut assemblies, fitted through appropriately aligned apertures in the mounting members 21, 22 at spaced locations about the adjoining flanges of the deck and gunwale.

Figure 6:
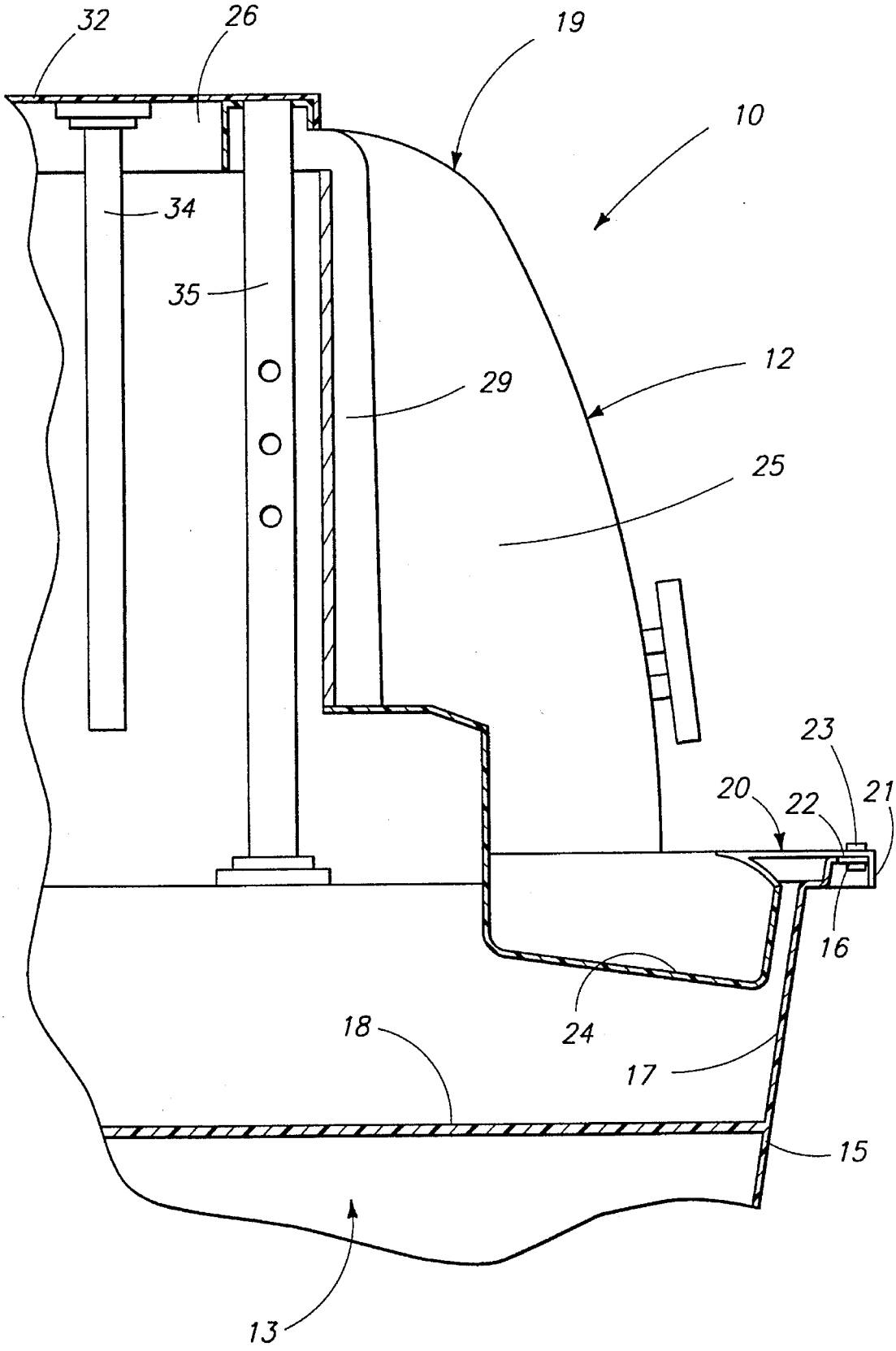
FIG. 6 is an enlarged fragmented sectional view taken substantially along line 6—6 is FIG. 5.

When mounted to the hull 13, the cabin house structure including the deck 20 is at least partially situated elevationally above the gunwale 16. In the example shown, only a portion of the deck, shown at 24 adjacent the transom 17 (FIG. 6) is situated below the gunwale. This is done to accommodate typical outboard motor mounts and controls as shown in FIG. 1.

The cabin house structure includes a bulwark 25 that, as indicated above, is integral with the deck 20 as a monolithic shell structure. The bulwark extends upwardly from the deck 20, to an open top hatch section 26 spaced above both decks 18 and 20.

In a preferred form, at least one portal is formed through the bulwark and leading to the deck. In the example shown, three portals 27–29 are provided. One portal 27 is situated at the bow end of the hull. Another portal 28 is situated along the bulwark 25 alongside between the bow 14 and stern 15. A third portal 29 is formed in the bulwark adjacent the stern 15.

Figure 4:
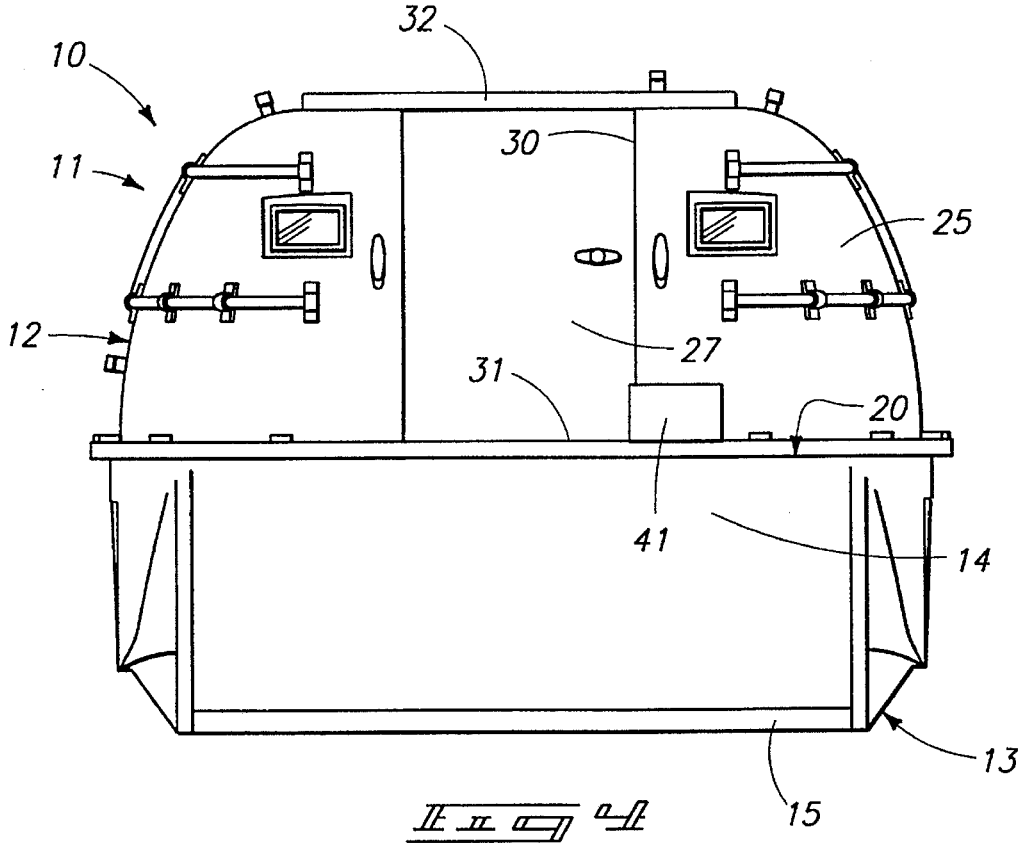
FIG. 4 is a rear elevation view showing the stern end.
Figure 4:
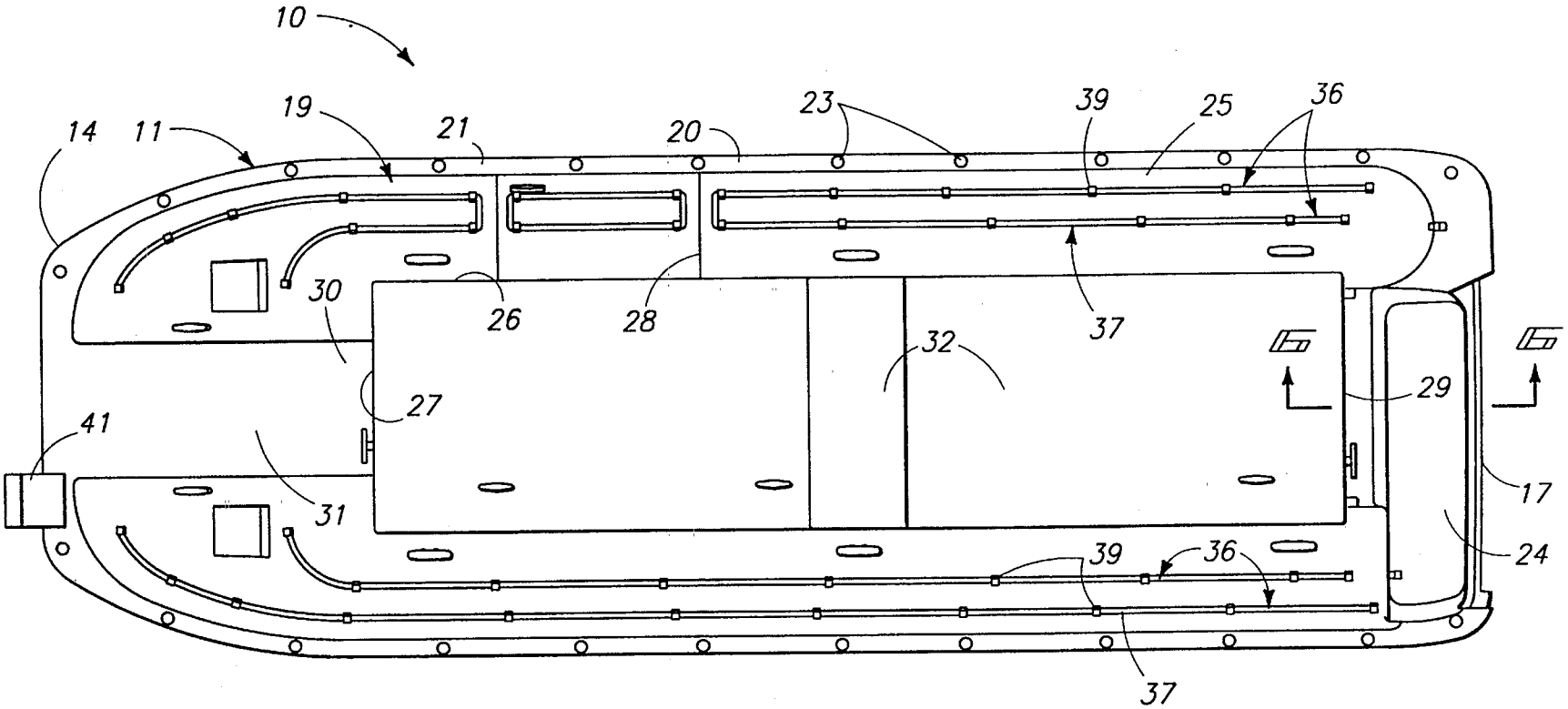

In the illustrated example, the portal 27 (FIG. 4) is selectively closed by a hinged door that faces the bow 14 from within a recess 30 (FIG. 5) formed in the bulwark adjacent the bow end of the hull. The deck 20 includes a foredeck section 31 spanning the recess 30 and leading to the bow end of the hull.

This area is formed to gain several advantages. Firstly, it permits easy entrance and egress to the passenger compartment from the bow of the boat. It also permits a hunter easy access to the outside by a passenger, who may wish to sit on the foredeck 31 with feet dangling over the bow, as when decoys are being deployed. To this end, conventional cleats are provided on the bulwark to either side of the recess for attachment by a safety strap (not shown) of a conventional nature. Other similar cleats may also be provided elsewhere about the bulwark as needed.

The recess 30 and foredeck 31 has further benefit when dogs are used for waterfowl retrieval. The foredeck 31 is accessible to the dog, and the bulwark surfaces around the recess present a fairly enclosed, concealed area for the dog that is separate from the passenger compartment for the dog to shake off water, and on which the dog may be stationed during the hunt.

Figure 2:
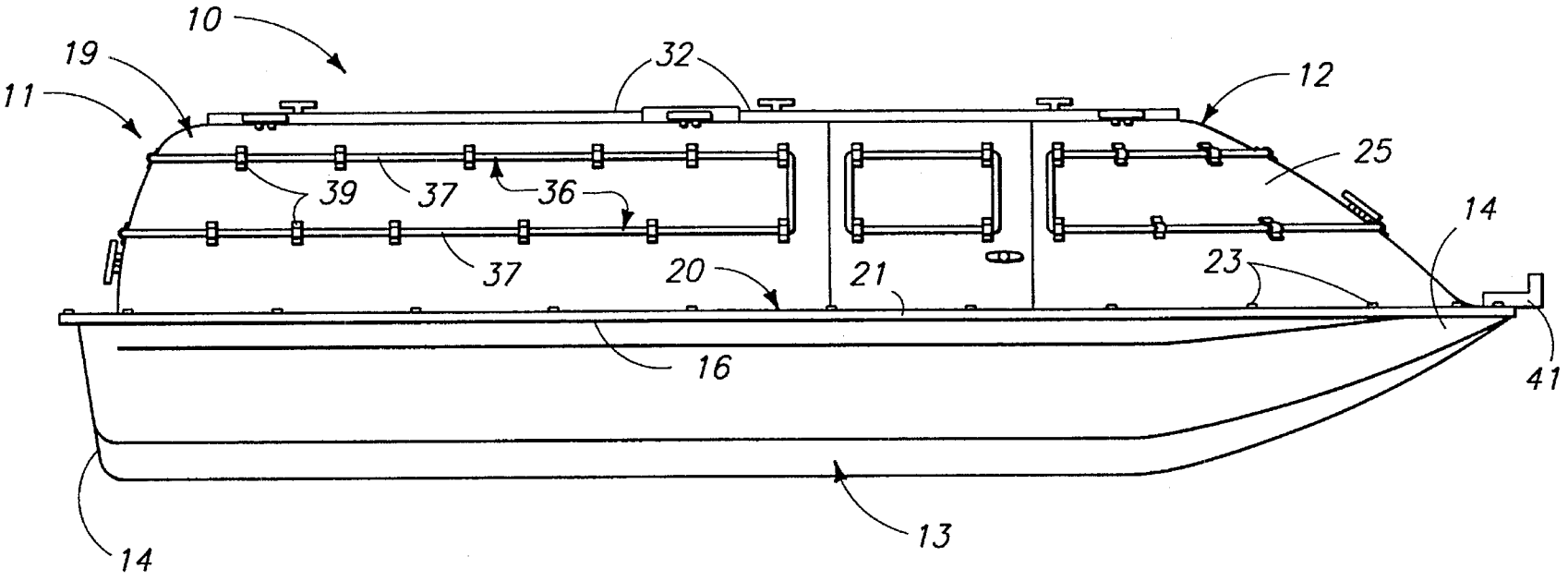
FIG. 2 is an opposite side elevation view thereof.
Figure 3:
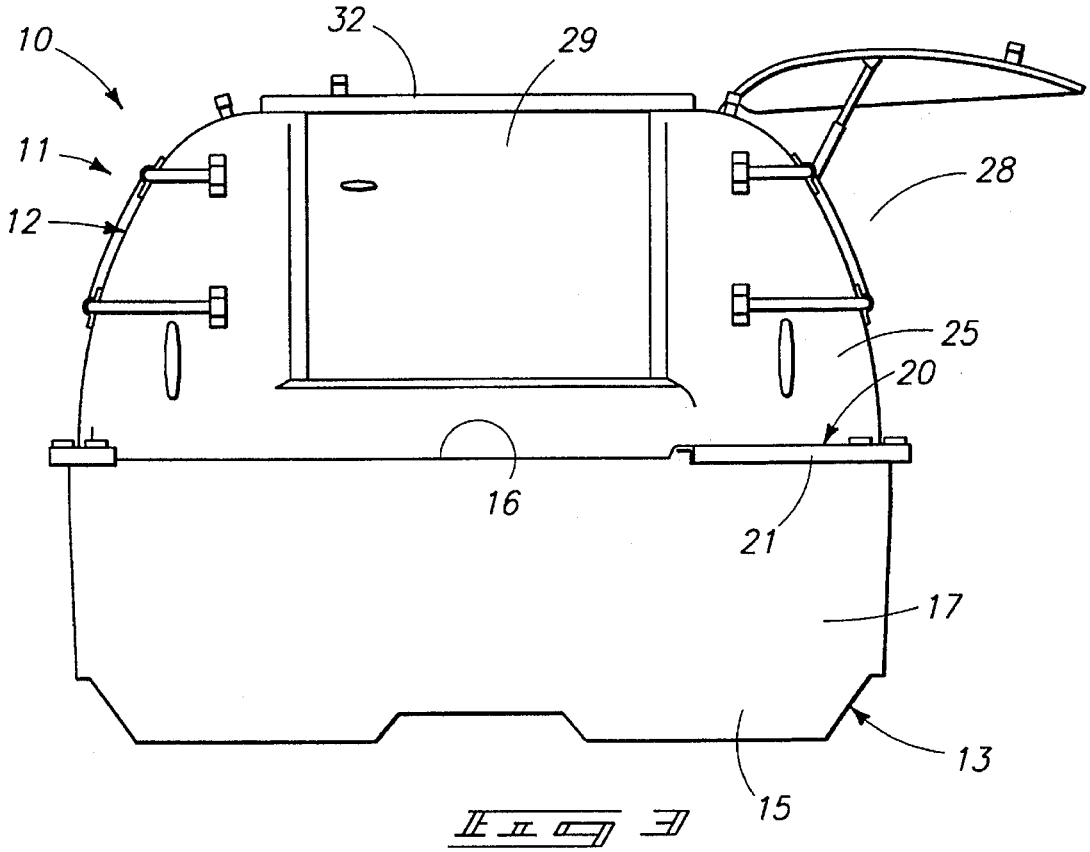
FIG. 3 is a front elevation view showing the bow end with a side door open.

The second portal 28 (FIG. 2), in the example shown, is situated along the bulwark 25 approximately midway between the bow and stern. This portal may be selectively covered by a "gull-wing" form of door (FIG. 3), hinged from above, and that may be opened for side entrance and egress purposes. A standard door lift and damper may be provided to assist in holding the door in the open condition.

The stern portal 29 (FIG. 3) is formed through the bulwark, primarily for access to the transom and an outboard motor that may be mounted thereon. A guillotine or slider form of door may be mounted to selectively cover portal 29.

The bulwark extends upwardly from the deck to define the open top hatch section 26 (FIG. 10) as briefly discussed above. The open hatch section 26 extends along a substantial portion of the cabin house structure length. It is covered at least partially by a hatch cover 32 that spans at least part of the open hatch area over the sole deck 18. The cover 32 exemplified in the drawings is provided in two overlapping sections that may be independently moved from a first position engaging the bulwark and covering the otherwise open hatch section 26, to a second position spaced upwardly clear of the opening.

In the second positions, the cover sections are useful as a roof structure, shielding the passenger compartment from above, while permitting the passengers to see outwardly over the top of the bulwark.

Conventional latch mechanisms are provided in the illustrated example for the cover 32, as well as the various doors mentioned above, to facilitate access and securing the craft when not in use. The latch mechanisms, when activated to release the hatch cover 32 from the first position, allow the cover to be lifted from the bulwark to the second, elevated position.

Figure 9:
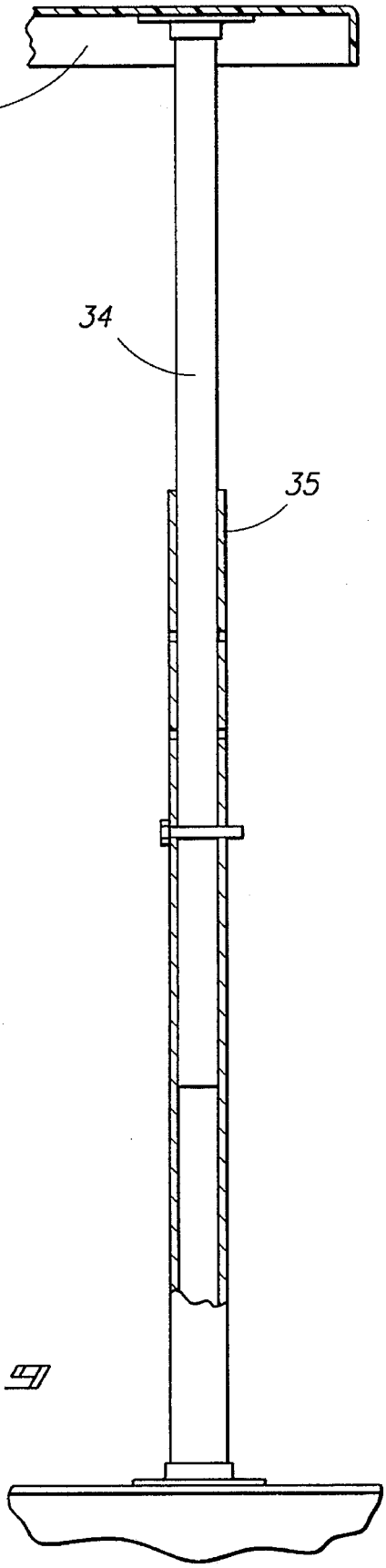
FIG. 9 is an enlarged fragmented sectional view of a support arrangement for holding a hatch cover in an elevated position.
Figure 11:
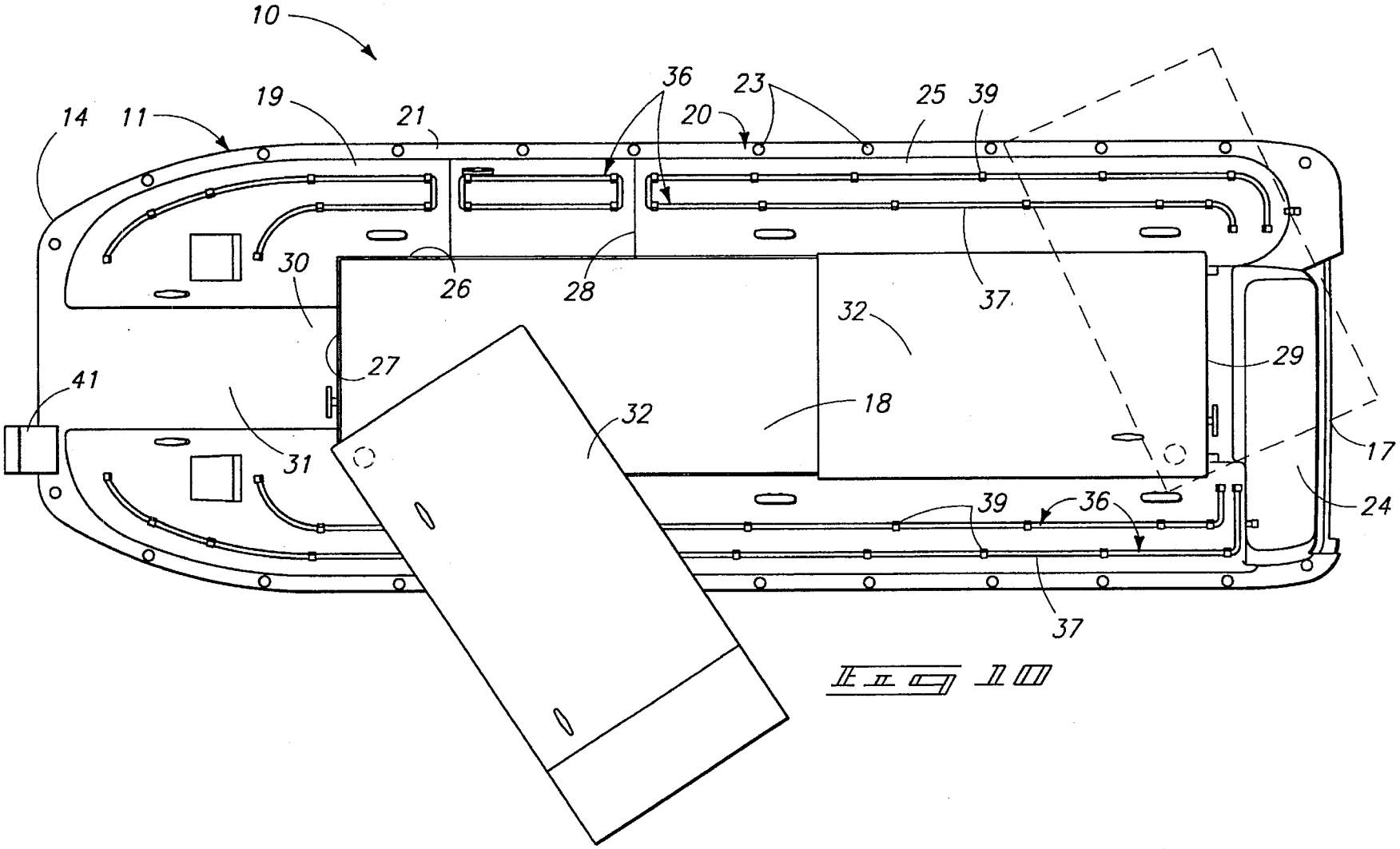
Figure 11:
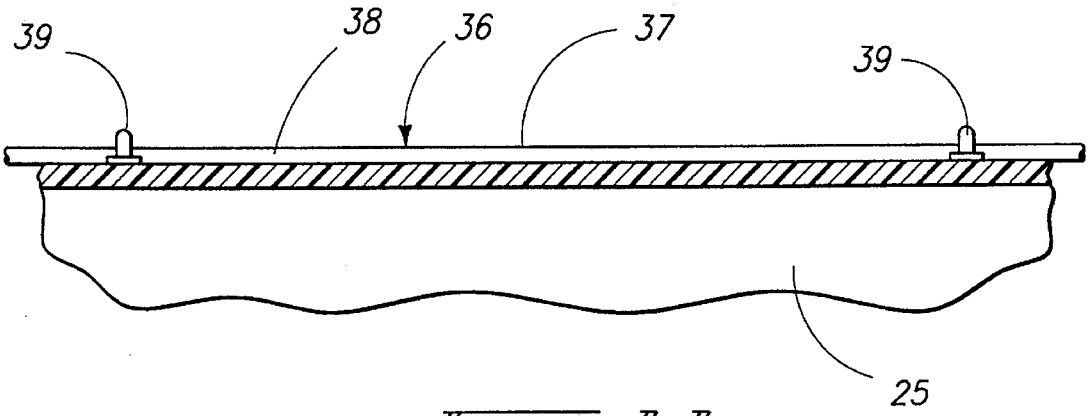

A hatch cover support assembly 33 (FIGS. 1 and 9) is provided in a preferred form, mounted to the hatch cover and bulwark. Support assembly 33 is selectively operable to support the hatch cover 32 at the second position, elevated above the open top hatch section 26.

The hatch cover support assembly 33 includes a post 34 and a socket member 35. In the example illustrated, the post 34 is mounted to the hatch cover 32, and the socket 35 is mounted to the bulwark inside the passenger compartment. Alternatively, the post could be mounted to the bulwark, and the socket to the cover 32.

A post 34 and socket 35 is provided in the example shown at one corner of each hatch cover section 32, enabling each section to shift elevationally between the two positions. Further, the post and socket arrangement enables the cover sections to be pivoted independently about the respective socket axis, as shown in FIG. 10. The cover sections may thus be easily moved aside, lending open visibility overhead. This is an advantage to hunters during shooting, in that a nearly hemispherical shooting sector is possible with the cover sections pivoted aside.

The sockets 35 are provided with spaced holes as shown in FIG. 10 that will permit selection of the supported height for the associated cover section 32. The bottom end of the slidably received post 34 will rest against the selectively placed pin. The pins and sockets will thus hold the post and the cover section cantilevered therefrom at the selected elevation, and will permit the cover sections to be rotated on the vertical axes of the mated posts and sockets as shown in FIG. 10.

Figure 11:
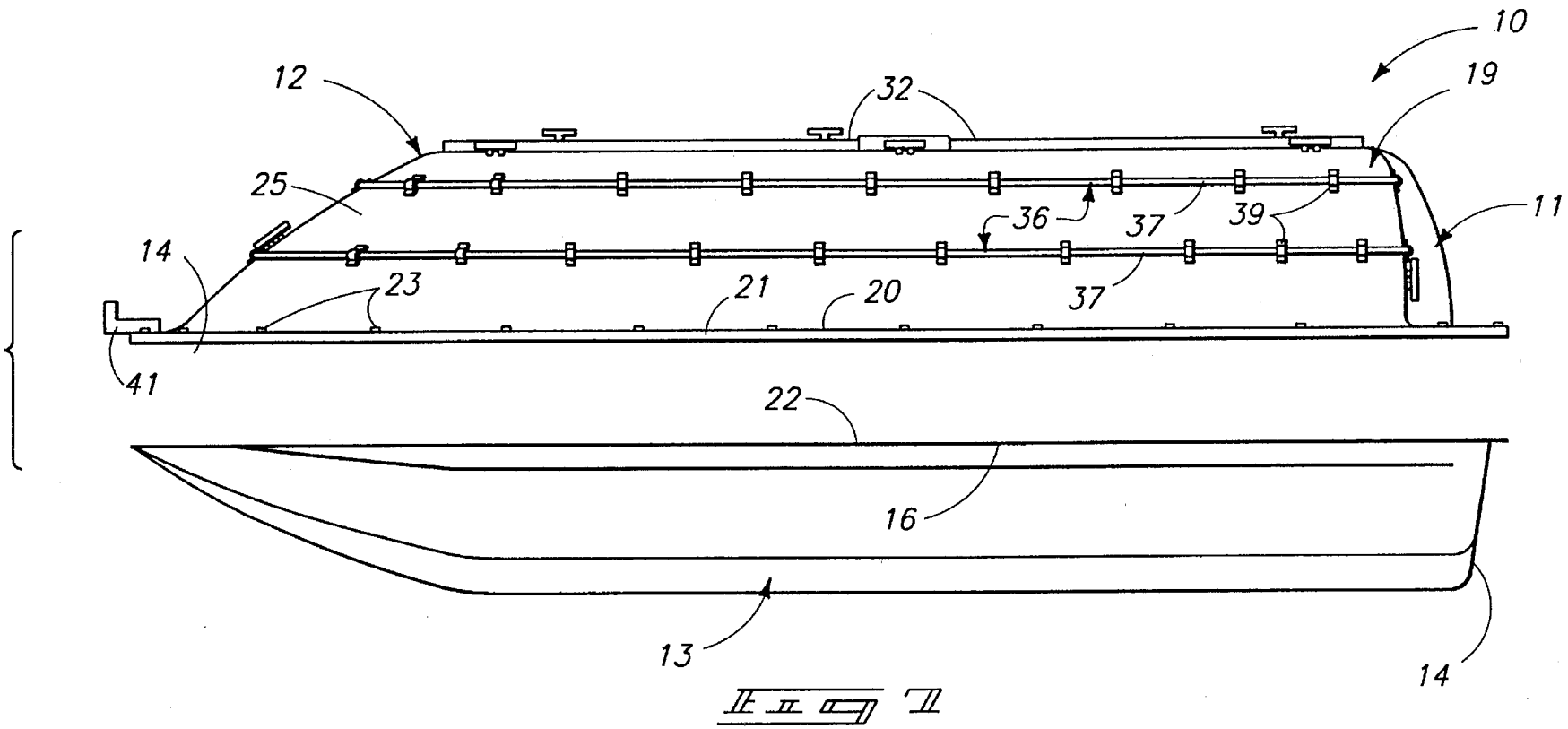
FIG. 11 is an enlarged fragmented sectional view illustrating part of a camouflage receiver, taken along line 11—11 in FIG. 10.
Figure 12:
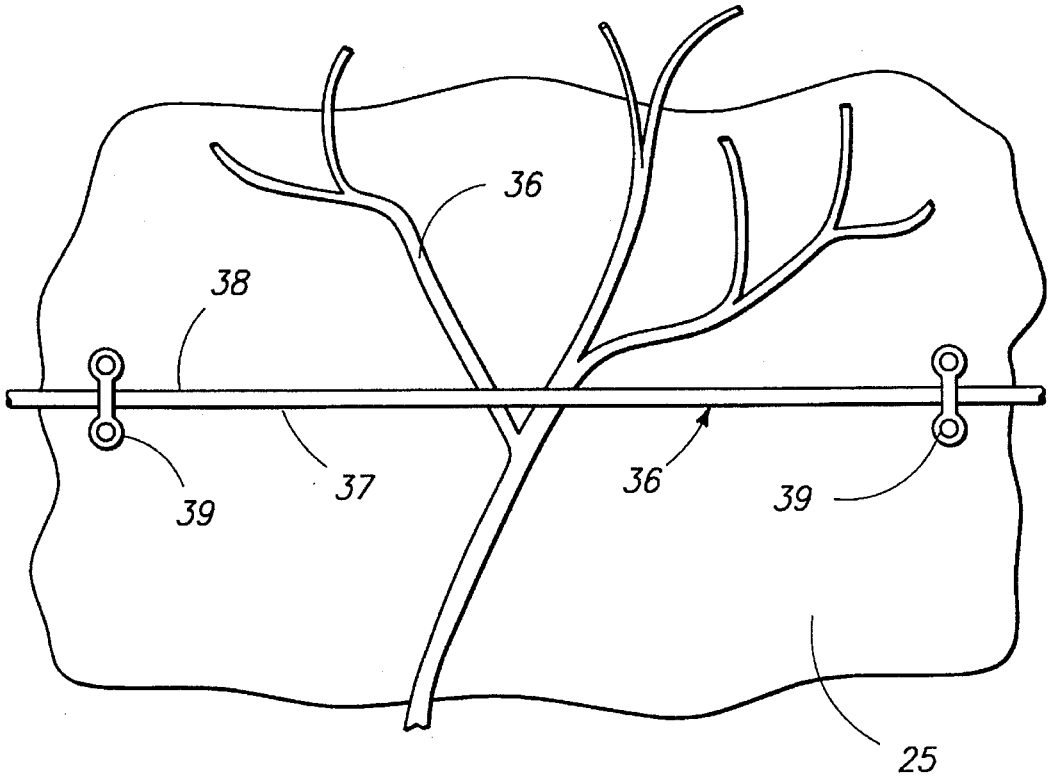
FIG. 12 is a diagrammatic elevational view illustrating camouflage material attached to the camouflage receiver.
Figure 11:
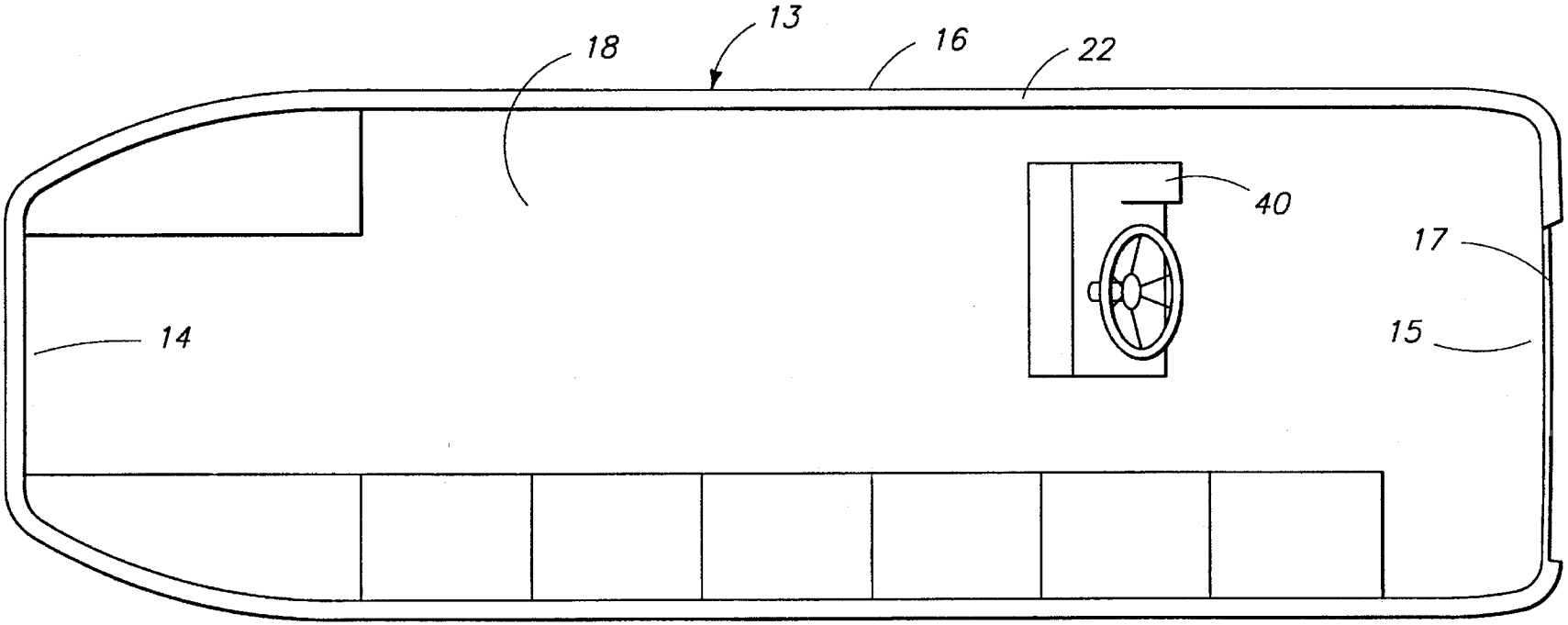

A duck blind camouflage receiver, generally shown at 36 and in detail in FIGS. 11 and 12 is situated on the bulwark enabling the entire watercraft to be camouflaged with foliage or materials indigenous to the area being hunted. In a preferred form, the camouflage receiver is comprised of elongated elastic cord segments 37 secured along the bulwark, with at least one, and preferably numerous resilient sections adapted to be stretched to receive and clamp camouflage material 38 against the bulwark.

The cord segments 37 are held against the bulwark at spaced locations by clips 39. Similar segments and clips may also be provided along the hull 13 and the cover 32.

For operation of the craft, an operator's station 40 is provided within the hull 13, along the sole deck 18. The station may include appropriate controls and instrumentation well known in the small water craft industry for permitting operation of the craft from within the passenger compartment. The operator may sit or stand at the operators station, with his or her head projecting through the top hatch for visibility.

As an added feature, an auxiliary motor mount 41 may be provided adjacent the bow 14 for supporting an auxiliary motor (not shown) to facilitate slow maneuvering of the craft from the bow during certain stages of hunting or fishing operations.

Given the above description of the invention, its operation will become readily apparent. Operation will be described assuming a starting condition with the cabin house assembly 12 in place on the hull 13 and with the hatch cover closed. Operation will further be described using a duck hunting trip as an operative first example, and a fishing expedition as a second example.

The complete craft may be transported to and from by conventional trailer and towing vehicle, and may be loaded and launched in the usual manner. After launching, the passengers may board using either the front or side portals. Before casting off and moving under power to a selected site, the operator will first shift one or both of the cover sections 32 to the elevated position as shown in FIG. 1. This allows maximum visibility during transit.

To lift the covers 32 to the elevated positions, the appropriate latches on the cover sections 32 are released and the covers are lifted upwardly over the open top hatch 26. The posts 34 are slid in the sockets 35 to positions where the covers are at a desired height. Pins (FIG. 9) are slipped through selected holes in the sockets to set the height. The operator now has normal visibility for piloting the craft from an appropriate operators console 40 within the passenger compartment to a selected site. Lights provided at the bow end of the bulwark may be used as needed.

After arriving at the selected hunting site, the passengers may scout about for appropriate camouflage materials indigenous to the area. Various forms of vegetation may be collected by one of the hunters and clipped to the craft using the camouflage receiver 36. In attaching the materials, the elastic cord sections 37 are simply stretched out, and the vegetation or other selected camouflage material is slipped into place between the sections and the underlying parts of the craft. Enough material is selected and placed to effectively camouflage the craft as desired.

Now the hunters may elect to deploy decoys. The craft may be maneuvered at this time, using the primary outboard as the power source. Alternatively, a smaller auxiliary outboard unit such as an electric outboard motor (not shown) may be provided and attached to a motor mount 41 at the bow of the craft.

The hunter placing decoys may sit at the bow on the foredeck, with feet dangling over the bow. An appropriate strap may be fastened between the provided cleats, extending across the hunter's midriff as a safety measure to prevent the hunter from falling into the water. Using an auxiliary outboard at the bow end, the hunter placing the decoys has complete control of the craft's movement.

Once decoys are placed, the craft may be anchored in the usual manner, the hunters are now situated to await their prey. If an overnight stay is in order, or if weather is inclement, the cover sections may be selectively lowered, covering the passenger compartment to provide a closed area that may be easily heated using a conventional portable heater.

Just prior to the active part of the hunt, the covers are raised, and may be pivoted aside. This allows the hunters free visibility and a shooting sector that, from a standing position within the passenger compartment, is nearly hemispherical.

If a hunting dog is to be used for bird retrieval, the forward door may be opened and the dog led to the foredeck, where it may rest, awaiting a successful shot. To retrieve a downed bird, the dog may simply leap from the foredeck, retrieve the bird, and gain access again to the craft using the foredeck. The successful hunter may reach over the closed front door to receive the bird from the dog, and the dog can shake outside the passenger compartment without affecting those inside.

Following the hunt, the camouflage material may be removed and the craft may be piloted back to the landing and trailered home. Storage of the craft is simple and requires no special storage facility, since the passenger compartment may be effectively sealed from the weather.

In the spring, the craft may be easily converted for a fishing expedition.

To do this, the duck blind cabin house assembly 12 is simply lifted off the hull 13. This is done by removing the clamps 23, which effectively release the assembly 12. Ordinary hoisting mechanisms may be attached to the various cleats on the bulwark and operated to lift the assembly 12 from the hull. The hull now may function as an ordinary recreational fishing boat, and may be used as such in the same manner as other similar craft. The open hull 13 will function well, using the same outboard power source, operated from the same console 40 as described above. As a fishing boat, the high, unobstructed gunwale 16 provides free access for fishing from any location about the perimeter of the hull.

Later, when desired, the duck blind cabin house assembly 12 may be re-attached to the hull by reversing the simple steps observed during removal.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A water craft with a removable duck blind cabin house assembly, comprising:

a hull including bow and stern ends, and a gunwale extending between the bow and stern ends;

a rigid cabin house structure and deck at least partially covering the hull above the gunwale;

a duck blind camouflage receiver on the cabin house structure; and respective interfitting mounting members on the deck and the gunwale, said mounting members being releasably engageable to mount the cabin house structure to the hull such that the cabin house structure may be selectively removed from the hull.

2. A water craft with a removable duck blind cabin house assembly as claimed by claim 1 wherein the respective interfitting mounting members include a first flange formed along the gunwale, and a second flange on the deck and shaped to overlap and cover the first flange; and clamp assemblies releasably clamping the first and second mounting members together.

3. A water craft with a removable duck blind cabin house assembly as claimed by claim 1 wherein the respective interfitting mounting members include a first flange formed along the gunwale, and a second flange formed integral with the deck on the cabin house structure and shaped to overlap and cover the first flange.

4. A water craft with a removable duck blind cabin house assembly as claimed by claim 1 wherein the cabin house structure includes a bulwark and wherein the deck and bulwark are integral and monolithic.

5. A water craft with a removable duck blind cabin house assembly as claimed by claim 1 wherein the cabin house structure includes a bulwark and wherein the camouflage receiver is situated on the bulwark.

6. A water craft with a removable duck blind cabin house assembly as claimed by claim 1 wherein the cabin house structure includes a bulwark and wherein the camouflage receiver is mounted to the bulwark;

wherein the camouflage receiver being comprised of an elongated elastic cord secured along the bulwark, with at least one resilient section adapted to be stretched to receive and clamp camouflage material against the bulwark.

7. A water craft with a removable duck blind cabin house assembly as claimed by claim 1 wherein the cabin house structure includes:

a bulwark extending upwardly from and integral with the deck, to an open top hatch section.

8. A water craft with a removable duck blind cabin house assembly as claimed by claim 1 wherein the cabin house structure includes:

a bulwark extending upwardly from and integral with the deck, to an open top hatch section spaced above the deck; and a hatch cover spanning at least part of the open top hatch section.

9. A water craft with a removable duck blind cabin house assembly as claimed by claim 1 wherein the cabin house structure includes:

a bulwark extending upwardly from and integral with the deck, to an open top hatch section;

a hatch cover spanning at least part of the open top hatch section; and a hatch cover support assembly mounted to the hatch cover and bulwark, selectively operable to support the hatch cover at an elevation above the open top hatch section.

10. A water craft with a removable duck blind cabin house assembly as claimed in claim 1 wherein the cabin house structure includes:

a bulwark extending upwardly from the deck, to an open top hatch section;

a hatch cover spanning at least part of the open top hatch section;

a hatch cover support assembly mounted to the hatch cover and bulwark selectively operable to support the hatch cover at an elevation above the open top hatch section;

wherein the hatch cover support assembly includes a post mounted to one of the hatch cover or bulwark, and a socket member mounted to the other one of the hatch cover or bulwark slidably receiving the post such that the hatch cover may be selectively pivoted about the socket clear of the open top hatch section.

11. A water craft with a removable duck blind cabin house assembly as claimed by claim 1 wherein the cabin house structure includes:

a bulwark extending upwardly from and integral with the deck, to a top hatch section; and at least one portal formed through the bulwark and leading to the deck.

12. A water craft with a removable duck blind cabin house assembly as claimed by claim 1 wherein the cabin house structure includes:

a bulwark extending upwardly from the deck; and a portal formed through the bulwark and leading to the deck at the bow end of the hull.

13. A water craft with a removable duck blind cabin house assembly as claimed by claim 1 wherein the cabin house structure includes:

a bulwark extending upwardly from the deck;

a recess formed by the bulwark adjacent the bow end of the hull;

the deck including a foredeck section spanning the recess and leading to the bow end of the hull; and a portal formed through the bulwark within the recess and leading to the foredeck section.

14. A duck blind cabin house assembly for removable attachment to a boat hull, comprising:

a cabin house structure including a bulwark;

a camouflage receiver mounted to the bulwark;

wherein the camouflage receiver is comprised of an elongated elastic cord secured along the bulwark, with at least one resilient section adapted to be stretched to receive and clamp camouflage material against the bulwark; and a mounting member on the cabin house structure operable to releasably secure the cabin house structure to a boat hull such that the cabin house structure at least partially covers the hull.

15. A water craft with a removable duck blind cabin house assembly, comprising:

a hull including bow and stern ends, and a gunwale extending between the bow and stern ends;

a rigid cabin house structure including a deck at least partially covering the hull above the gunwale;

a bulwark extending upwardly from the deck;

a recess formed by the bulwark adjacent the bow end of the hull;

the deck including a foredeck section spanning the recess and leading to the bow end of the hull;

a portal formed through the bulwark within the recess and leading to the foredeck section;

a duck blind camouflage receiver on the cabin house structure; and respective interfitting mounting members on the cabin house structure and the gunwale, said mounting members being releasably engageable to mount the cabin house structure to the hull such that the cabin house structure may be selectively removed from the hull.

16. A water craft with a removable duck blind cabin house assembly, comprising:

a hull including bow and stern ends, and a gunwale extending between the bow and stern ends defining an open passenger compartment;

the hull including a sole deck surface situated below and inboard of the gunwale;

a rigid cabin house structure;

a duck blind camouflage receiver on the cabin house structure; and mounting members on the hull and cabin house structure operable to (a) secure the cabin house structure to the hull in a first condition at least partially covering the hull above the sole deck and forming an at least partially enclosed passenger compartment so the water craft may be utilized as a duck blind, and (b) release the cabin house structure for removal from the hull to expose the sole deck such that the hull may be selectively utilized as an open boat.

17. A duck blind cabin house assembly for removable attachment to a boat hull, comprising:

a rigid cabin house structure including a bulwark and an integral deck;

a duck blind camouflage receiver on the bulwark; and a mounting member on the cabin house structure operable to releasably secure the deck to a boat hull such that the cabin house structure and deck at least partially covers the hull.

18. A duck blind cabin house assembly as claimed by claim 17, wherein the bulwark extends upwardly from the deck, to an open top hatch section spaced above the deck; and a hatch cover spanning at least part of the open top hatch section.

19. A duck blind cabin house assembly as claimed by claim 17, wherein the bulwark extends upwardly from the deck, to an open top hatch section spaced above the deck;

a hatch cover spanning at least part of the open top hatch section; and a hatch cover support assembly mounted to the hatch cover and bulwark, selectively operable to support the hatch cover at an elevation above the open top hatch section.

20. A duck blind cabin house assembly as claimed by claim 17, wherein the bulwark extends upwardly from the deck, to an open top hatch section spaced above the deck;

a hatch cover spanning at least part of the open top hatch section;

a hatch cover support assembly mounted to the hatch cover and bulwark, selectively operable to support the hatch cover at an elevation above the open top hatch section; and wherein the hatch cover support assembly includes a post mounted to one of the hatch cover or bulwark, and a socket member mounted to the other one of the hatch cover or bulwark slidably receiving the post in such a manner that the hatch cover may be selectively pivoted about the socket clear of the open top hatch section.

21. A duck blind cabin house assembly as claimed by claim 17, wherein the deck extends substantially horizontally from the bulwark, forming a gunwale receiving flange adapted to engage and overlap the gunwale of a boat.

* * * * *